United States Patent [19]

Woods

[11] 4,241,494

[45] Dec. 30, 1980

[54] METHOD OF ASSEMBLING AN ELECTRICAL DEVICE

[75] Inventor: Lee O. Woods, Morrison, Ill.

[73] Assignee: General Electric Company, Fort Wayne, Ind.

[21] Appl. No.: 959,914

[22] Filed: Nov. 13, 1978

Related U.S. Application Data

[62] Division of Ser. No. 829,276, Aug. 31, 1977, Pat. No. 4,164,000.

[51] Int. Cl.[3] ..... H01C 17/02

[52] U.S. Cl. ..... 29/619; 29/621; 29/854

[58] Field of Search ..... 29/613, 619, 621, 628, 29/513; 338/220, 332; 361/24, 25, 27; 318/783; 335/2, 6, 202

[56] References Cited

U.S. PATENT DOCUMENTS

| | | | |
|---|---|---|---|
| 1,710,999 | 4/1929 | Schmid | 29/513 X |
| 3,130,284 | 4/1964 | Woods | 335/156 |
| 3,287,675 | 11/1966 | Woods | 335/202 |
| 3,835,434 | 9/1974 | Kahn | 338/22 SD |
| 3,914,727 | 10/1975 | Fabricius | 361/27 X |
| 3,921,117 | 11/1975 | Blaha | 361/24 X |
| 3,965,392 | 6/1976 | Moorhead et al. | 361/29 |
| 3,988,709 | 10/1976 | McKinnon | 361/27 |
| 4,037,316 | 7/1977 | Stoll | 29/613 X |

*Primary Examiner*—Carl E. Hall

*Attorney, Agent, or Firm*—Joseph E. Papin

[57] ABSTRACT

A method of assembling an electrical device. In this method, a contact plate for a PTCR is disposed exteriorly of a casing therefor, and extensions on the contact plate are deformed into releasable securing engagement with the casing exteriorly thereof.

8 Claims, 9 Drawing Figures

METHOD OF ASSEMBLING AN ELECTRICAL DEVICE

CROSS-REFERENCE TO RELATED APPLICATION

This application is a division of application Ser. No. 829,276 filed Aug. 31, 1977 (now U.S. Pat. No. 4,164,000 issued Aug. 7, 1979) which is incorporated by reference herein.

FIELD OF THE INVENTION

This invention relates generally to electrical devices and in particular to a method of assembling such electrical devices.

BACKGROUND OF THE INVENTION

In the past, various types of prime movers, such as dynamoelectric machines or electric motors for instance, were provided with a winding circuit in a stationary assembly, such as a stator or the like, having parallel connected main or run winding means and an auxiliary or start winding means. During a starting mode or operation of these past types of prime movers, the winding circuit thereof was initially connected across a power source by suitable operator operated switching means to effect the generally conjoint excitation of the main winding means and the start winding means at least until a rotatable assembly magnetically associated with the main winding means and the auxiliary winding means of the stationary assembly was energized generally to a preselected speed. Of course, various prior art mechanisms or devices were utilized to render the auxiliary winding means ineffective in the winding circuit generally when the preselected speed of the prime mover, i.e., the rotatable assembly thereof, was attained.

Some of these prior art devices for controlling the excitation of the auxiliary winding means were mechanical speed responsive devices. For instance, when the rotatable assembly attained the preselected speed, a centrifugal mechanism carried on the rotatable assembly was actuated to move an associated collar generally axially on the rotatable assembly from an at-rest position toward another position, and upon such axial movement to its another position, the collar drove linkage means for operating a switch which effected the de-excitation of the auxiliary winding means by disconnecting it from the power source. Thus, with the auxiliary winding means rendered ineffective in the winding circuit, the prime mover then was energized generally at the preselected speed thereof in response to the continued excitation of the main winding means. Of course, at least one of the disadvantageous or undesirable features of the aforementioned centrifugal mechanism and associated linkage is believed to be those well-known limitations attributable to most all mechanical devices, such as tolerance problems, wear problems, noise problems and, in some instances, reliability problems.

In other types of these prior art prime movers, a current relay was employed for controlling the excitation of the auxiliary winding means. For instance, a coil of the current relay was serially connected in the winding circuit with the main winding means thereof, and contact means of the current relay was serially connected in the winding circuit with the auxiliary winding means thereof. When the prime mover was energized across the line, as previously mentioned, the coil of the current relay and the main winding means were excited, and the excitation of the relay coil effected the magnetic closure of the contact means of the relay so as to effect the excitation of the auxiliary winding means; therefore, in this manner, the main winding means and the auxiliary winding means were generally conjointly excited to energized the prime mover to generally its preselected speed during a starting mode thereof. Of course, when the prime mover was so energized generally to its preselected speed, the current draw of the main winding means was appreciably reduced, and such reduction of current caused the relay coil to weaken its magnetic affect thereby to permit the contact means of the current relay to return to their at-rest or open position. Thus, with the relay contacts so opened to interrupt current flow to the auxiliary winding means, the auxiliary winding means were rendered ineffective generally at the time the prime mover attains its preselected speed, and the prime mover remained energized generally at the preselected speed thereof during its running mode or operation in response to the continued excitation of the main winding means. At least one of the disadvantageous or undesirable features of such past prime movers utilizing a current relay for controlling excitation of the auxiliary winding means is believed to be that at least in some instances, the contact means of the current relay has a tendency to weld in response to the generally large current draw by the auxiliary windings during the starting operation of the prime mover. Another disadvantageous or undesirable feature is believed to be that the current relay generated radio and television interference at the instant of make and break due to arcing of the contact means.

Another one of the prior art devices for controlling the excitation of the auxiliary winding means was a positive temperature coefficient resistor (PTCR) which was connected in series with the auxiliary winding of the prime mover. When the prime mover was energized across the line, the main winding means and auxiliary winding means were initially conjointly excited since the PTCR exhibited little initial resistance to current flow to the auxiliary winding means. The PTCR acts generally as a low value resistor until its internal temperature reaches its "Curie" point or anomaly temperature at which time its resistance increases abruptly along with an increase of its temperature. Therefore, the temperature of the PTCR was increased in response to current flow therethrough to the auxiliary winding means during the starting operation of the prime mover, and generally at the time the prime mover attained its preselected speed, the resistance of the PTCR abruptly increased to a value appreciably limiting current flow therethrough. Thus, the auxiliary winding means was, in effect, rendered generally ineffective in the winding circuit generally at the time the prime mover attained its preselected speed, and the prime mover remained energized generally at the preselected speed thereof in response to the continued excitation of the main winding means. Of course, so long as the PTCR was energized, it remained "hot" exhibiting a high resistance to current flow, and it is believed that, under certain conditions, this may be a disadvantageous or undesirable feature. For instance, if for some reason the prime mover had not been energized to the preselected speed so that the torque of the main winding means alone would sustain such preselected speed, then the prime mover would stall to zero speed and remain there since the PTCR would, in effect, block current flow to the auxiliary winding means. If an overload protection system of the prime mover did not alleviate the aforementioned stalled condition or locked rotor condition of the prime mover or if such overload protection system did not reset itself before the PTCR had time to cool, this stalled condition of the prime mover would be perpetuated.

In the event the winding circuit of the prime mover was provided with run and/or start capacitors so that the PTCR was subjected to continuous voltage stress, it is believed that at least one disadvantageous or undesirable feature of this arrangement is that the PTCR may be subjected to voltage stress which may exceed the oversurface break down characteristic of the PTCR; therefore, as a result of this situation, it may have been necessary to provide the PTCR with a rather complicated and expensive external insulation system to inhibit such oversurface break down characteristics which, of course, is also believed to be a disadvantageous or undesirable feature. In addition to the foregoing, if "heat sinks", such as metallic fins or other metal masses or the like, were employed in conjunction with the PTCR to hasten its recovery after it has been de-energized, it is believed that the PTCR may be subjected to thermal stressing having a capacity to physically deteriorate or destroy the PTCR which is, of course, also believed to be a disadvantageous or undesirable feature.

The William C. Rathje application Ser. No. 778,335 filed Mar. 17, 1977 (now U.S. Pat. No. 4,161,681 issued July 17, 1979) illustrates the compatible use of a current relay, PTCR starting device and an overload protector with a winding circuit of a prime mover. The Lee O. Woods et al. U.S. Pat. No. 4,042,860 issued Aug. 16, 1977 and the Donald H. Stoll application Ser. No. 693,409 filed June 7, 1976 (now U.S. Pat. No. 4,084,202 issued Apr. 11, 1978) each disclose a combination starter-protector device utilized with a winding circuit of a prime mover.

In another past installation, a PTCR starting device was connected in a prime mover starting circuit by individual circuit leads, and a starting capacitor was connected across the PTCR starting device by similar individual circuit leads. In this type of circuit arrangement, the PTCR starting device and starting capacitor were either loosely hung on the individual circuit leads from a terminal board or the like of the prime mover or, in some instances, from a Fusite plug if the prime mover was operated in a hermetic environment. Thus, it is believed that at least one disadvantageous or undesirable feature of this type of circuit arrangement utilizing the aforementioned loosely hung electrical devices, such as for instance the starting capacitor, PTCR starting device as well as other electrical device for controlling the energization of a prime mover, was that such loosely hung electrical devices could be inadvertantly disconnected from each other by a workman or operator in the vicinity of the prime mover.

SUMMARY OF THE INVENTION

Among the several objects of the present invention may be noted the provision of an improved method of assembling an electrical device which overcome at least some of the above discussed disadvantageous or undesirable features, as well as others, with respect to the prior art; the provision of such improved method which includes a current relay and a solid state device arranged so that selected terminal means thereof are mechanically and electrically interconnected in circuit relation; and the provision of such improved method utilizing components which are simplistic in design, easily assembled and connected, and economically manufactured. These as well as other objects and advantageous features of the present invention will be in part apparent and in part pointed out hereinafter.

In general, a method is provided in one form of the invention for assembling an electrical device including relay means having a housing with at least one female terminal disposed therein and at least one switch means terminal extending exteriorly of the housing. In this method, a solid state device is disposed at least adjacent the housing, and the solid state device is connected in circuit relation between the at least one female terminal and the at least one switch means terminal.

Also in general, a method is provided in one form of the invention for assembling an electrical device having a housing with recess means therein and an opening in the housing communicating with the recess means. This method includes the steps of: positioning in the recess means means for electrically contacting and supporting a solid state component with the contacting and supporting means having terminal means protruding at least in part through the opening; inserting the solid state component into the recess means into engagement with the contacting and supporting means; and arranging means for electrically contacting and supporting the solid state component on the housing in engagement with the solid state component so as to enclose at least in part the recess means and securing to the housing the another contacting and supporting means with another terminal means thereof disposed exteriorly of the housing.

BRIEF DESCRIPTION OF THE DRAWINGS

Corresponding reference characters indicate corresponding parts throughout the several views of the drawings.

The exemplifications set out herein illustrate the preferred embodiment of the present invention in one form thereof, and such exemplifications are not to be construed as limiting in any manner the scope of the invention or the disclosure thereof.

DETAILED DESCRIPTION OF THE PREFERRED EMBODIMENTS

Figure 1:
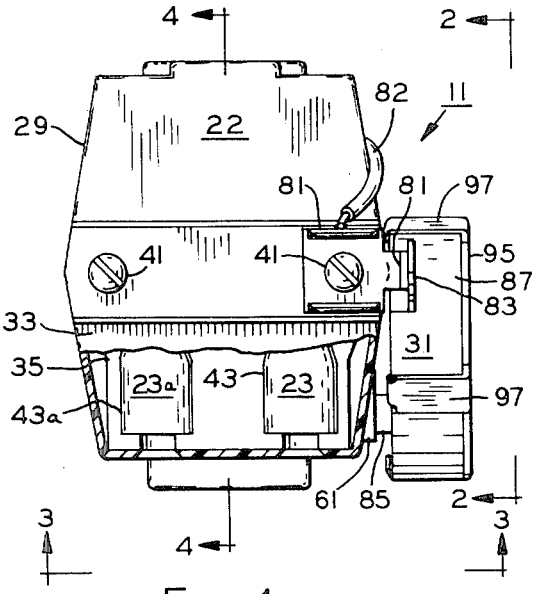
FIG. 1 is a plan view illustrating a combination relay-starter device teaching principles which may be utilized in a method of assembling such device in one form of the invention.
Figure 2:
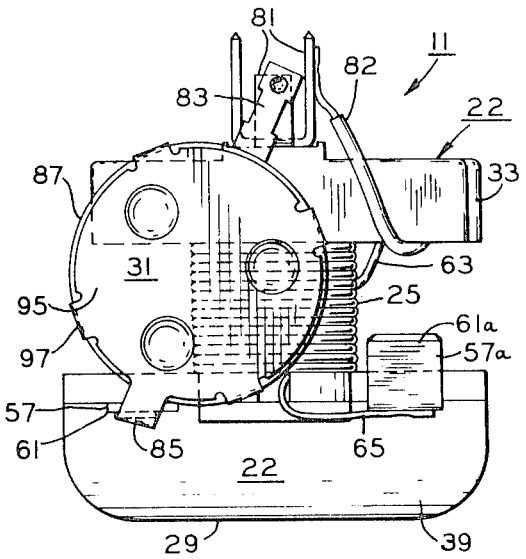
FIG. 2 is a right side elevational view of the device of FIG. 1.
Figure 3:
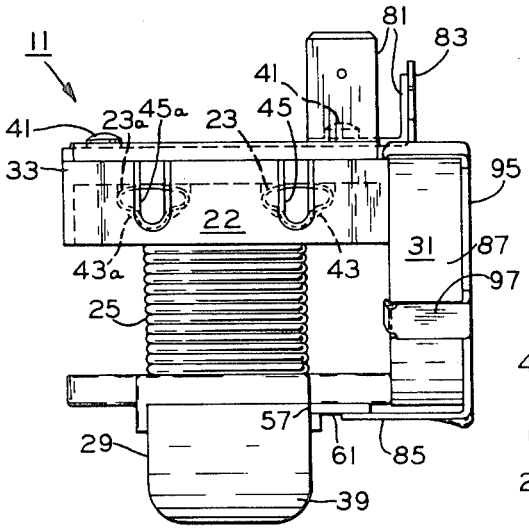
FIG. 3 is a rear elevational view of the device of FIG. 1.
Figure 4:
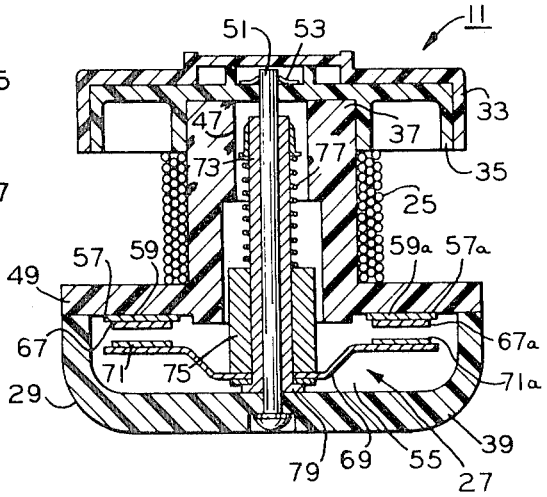
FIG. 4 is a sectional view taken along line 4—4 in FIG. 1.

Referring now to the drawings in general, an electrical device, such as a combination relay-starter device 11, is adapted for connection in circuit relation, i.e. removably mounted in plug-on circuit relation, with a pair of terminals, such as male terminals 13, 13*a*, electrically associated with auxiliary or start winding means 15 and main or run winding means 17 in a winding circuit 19 of a prime mover, such as a dynamoelectric machine or electric motor 21 (FIGS. 1–4 and 9). Electrical device 11 includes current relay means 22 which has a pair of terminal means, such as female terminals 23, 23*a*, adapted to receive male terminals 13, 13*a* in the plug-on circuit relation, coil means 25, and means, such as a switch or switch means indicated generally at 27, arranged in magnetic coupling relation with the coil means so as to be operable generally between a circuit interrupting position and a circuit completing position (FIGS. 1 and 4). Means, as indicated generally at 29, is provided for housing female terminals 23, 23*a*, coil means 25, and switch or switching means 27, and electrical device 11 also includes a solid state device 31 associated with housing means 29 and connected in circuit relation between the switching means and one of the female terminals so as to be de-energized when the switching means is in its circuit interrupting position (FIGS. 1–4).

More particularly and with specific reference to FIGS. 1–4, housing means or housing 29 has a plurality of housing portions which are molded or otherwise formed of suitable dielectric material, such as any suitable plastic for instance, and such housing portions include a cover 33, a flange 35, a bobbin 37 and a closure member 39. Cover 33 is releasably secured to flange 35 by suitable means, such as for instance a pair of screws 41 or the like, so as to capture female terminals 23, 23*a* in a pair of cavities 43, 43*a* provided therefore in the flange, and a pair of openings or apertures 45, 45*a* in the cover are located with respect to the cavities and the female terminals therein for accommodating the passage of male terminals 13, 13*a* through the cover openings toward the cavities so as to be received into electrical contacting engagement with the female terminals when electrical device is removably mounted in the plug-on relation with the male terminals. Thus, cover 33 and flange 35 with female terminals 23, 23*a* captured therebetween comprise a receptacle means for electrical device 11 which is removably mounted in the plug-on relation with male terminals 13, 13*a*. While screws 41 are disclosed above as releasably securing cover 33 and flange 35, it is contemplated that other means may be utilized within the scope of the invention so as to meet the objects thereof for releasably securing the cover and flange, such as disclosed in the Thomas J. Kindelspire application Ser. No. 795,797 filed May 11, 1977 for instance.

Bobbin 37 has a bore 47 extending between the opposite ends thereof, and an integral base 49 extends generally radially of the bobbin adjacent one of the opposite ends thereof. A headed pin 51 extending through bobbin bore 47, closure member 39 and flange 35 retains the closure member seated on bobbin base 49 and retains the flange seated on the other end of bobbin 37, and a jam nut or washer 53 or the like is fixedly connected between the pin and the flange thereby to retain the flange and closure member against displacement from the bobbin. Thus, flange 35, bobbin 37 and closure member 39 enclose or define a switching or switch means operating chamber 55 which includes bobbin bore 47. A pair of terminal means, such as switch or switching means terminals 57, 57*a*, are mounted between bobbin base 49 and closure member 39 and have contact sections 59, 59*a* and electrical connector sections 61, 61*a* extending interiorly and exteriorly of switch means chamber 55, respectively.

Coil means or relay coil 25 comprises a plurality of turns of dielectrically coated wire wound about bobbin 37 between base 49 thereof and flange 35, and one end or lead part 64 of the turn plurality extends between cover 33 and flange 35 and is connected by suitable means, such as soldering or crimping for instance, with female terminal 23*a* while the other end or lead part 65 of the turn plurality is connected by suitable means, such as soldering for instance, to the exterior end or electrical connector section of switch means terminal 57*a*.

Switching means 27 includes switch means terminals 57, 57*a* which have a pair of contacts 67, 67*a* mounted to contact sections 61, 61*a* of the switch means terminals in chamber 55, and a bridge 69 carries another pair of contacts 71, 71*a* adapted for making and breaking engagement with contacts 67, 67*a*, respectively. Bridge 69 is carried adjacent the lower end of a sleeve 73 slidably movable on pin 51, and an armature means 75 is slidably received about the sleeve and predeterminately positioned so as to be coupled in magnetic relation with coil means 25 upon the energization thereof. Resilient means, such as a coil spring 77, is caged between armature means 75 and the upper end of sleeve 73. Thus in the at-rest or circuit interrupting position of switching means 27, the weight of armature means 75 acting on bridge 69 urges it into abutment with a hub 79 on the lower end of sleeve 73 and also urges the hub into abutment with closure member 39 thereby to break or disengage contacts 71, 71*a* from contacts 67, 67*a* in the circuit interrupting position of switching means 27.

A dummy terminal 81 is secured or otherwise mounted to cover 33 by one of the screws 41 so as to be disposed generally in the vicinity of solid state or electrical device 31, and another lead 82 which extends between the cover and flange 35 is connected in circuit relation between the dummy terminal and female terminal 23 by suitable means such as soldering or crimping or the like. While dummy terminal 81 is disclosed as being mounted by screw 41 to cover 33, it is contemplated that the dummy terminal may be so mounted or secured by other suitable means, such as being molded in place, staked in place or riveted or the like, within the scope of the invention so as to meet the objects and advantageous features thereof. As discussed in greater detail hereinafter, solid state device 31 is a PTCR starting or starting controlling device and has a pair of terminals or terminal means 83, 85 extending at least in part exteriorly thereof, and the terminals are both mechanically and electrically mounted or connected directly onto dummy terminal 81 and electrical connector section 61 of switch means terminal 57 by suitable means, such as for instance soldering or the like; however, it is also contemplated that terminals 83, 85, dummy terminal 81 and switch means terminal 57 may have shapes or configurations other than those disclosed herein so as to be both mechanically and electrically mounted together within the scope of the invention so as to meet the objects and advantageous features thereof. For instance, terminals 83, 85, dummy terminal 81 and switch means terminal 57 may be of the mating plug-on type or other quick connect or disconnect types. Thus, with terminals 83, 85 of solid state device 31 interconnected with dummy terminal 81 and switch means terminal 57, the solid state device is connected in circuit relation between switching means 27 and female terminal 23.

Referring again in general to the drawings and recapitulating at least in part with respect to the foregoing, a method in one form of the invention is provided for assembling electrical device 11 which includes current relay means 22 having housing means 29 provided with at least one female terminal 23 disposed therein and at least one switch means terminal 57 extending exteriorly of the mounting means (FIGS. 1 and 4). In this method, solid state device 31 is disposed at least closely adjacent housing means 29 exteriorly thereof, and the solid state device is connected in circuit relation between female terminal 23 and switch means terminal 57. As previously discussed, the connection of solid state device 31 in the circuit relation between switching means 27 and female terminal 23 is effected by the direct mechanical and electrical mounting or connection of solid state device terminals 83, 85 with dummy terminal 81 and switch means terminal 57 with the dummy terminal being electrically connected by lead 82 in the circuit relation to female terminal 23.

Figure 5:
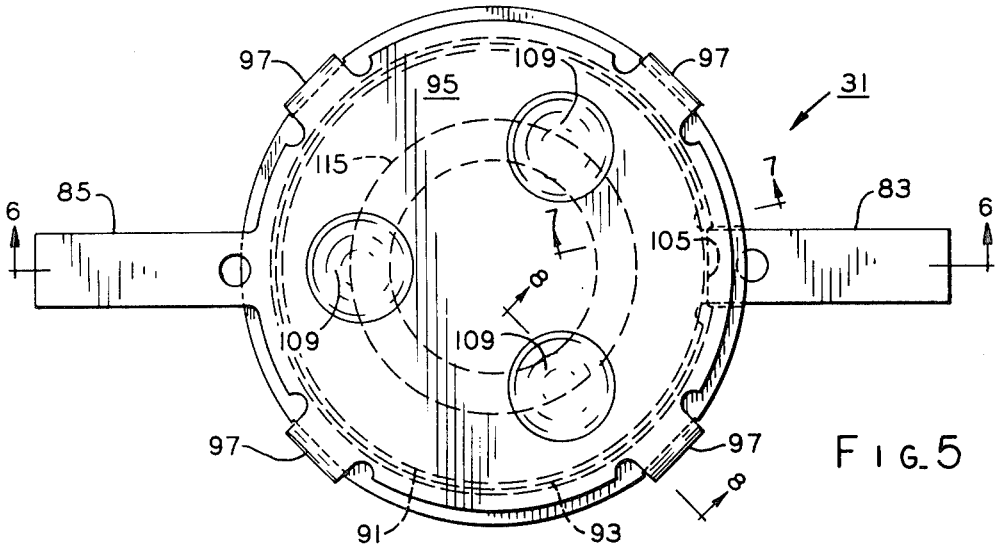
FIG. 5 is a plan view of a starter device as shown separated from the device of FIG. 1 and teaching principles which may be utilized in a method of assembling the starter device also in one form of the invention.
Figure 6:
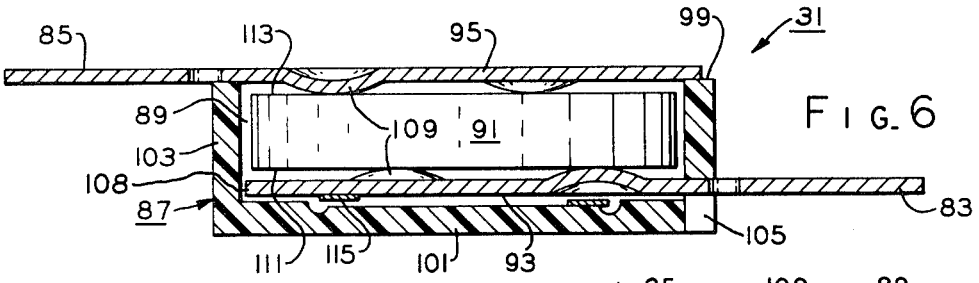
FIG. 6 is a sectional view taken along line 6—6 of FIG. 5.
Figure 7:
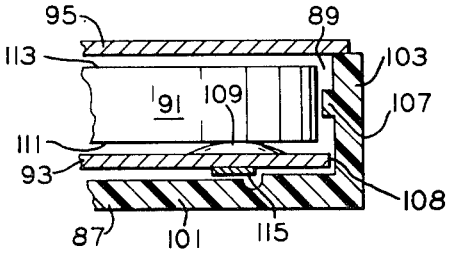
FIGS. 7 and 8 are partial sectional views respectively taken along lines 7—7 and 8—8 in FIG. 5, respectively.
Figure 8:
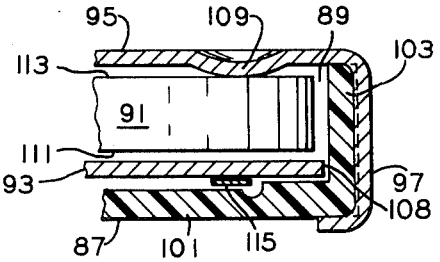

Solid state or electrical device 31 in one form of the invention has a casing 87 with recess means 89 therein, and a solid state component, such as a PTCR 91, is disposed in the recess means (FIGS. 5–8). Means, such as a metal contact plate 93 or the like, for electrically contacting and supporting PTCR 91 is disposed within recess means 89 and includes terminal 83 integrally formed or connected therewith, and the terminal extends at least in part through casing 87 exteriorly thereof (FIGS. 5 and 6). Means is arranged with casing 87 so as to close at least in part recess means 89 for retaining against displacement therefrom PTCR 91, and the displacement preventing means comprises means, such as another metal contact plate 95 or the like, for electrically contacting and supporting the PTCR in the recess means (FIGS. 5 and 6). Contacting and supporting means or plate 95 includes terminal 85 which is integrally formed or connected therewith and also a plurality of means, such as fingers or straps 97, for releasably securing plate 95 with casing 87 (FIGS. 5, 6 and 8). Of course, solid state device 31 is adapted for connection generally in circuit 19 of prime mover 21 (FIG. 9), as discussed in greater detail hereinafter.

More particularly and with specific reference to FIGS. 5–8, casing 87 of solid state device 31 is provided with a plurality of wall means including a pair of generally opposite end walls or portions 99, 101 integrally interconnected by a sidewall 103 so as to generally define recess or recess means 89, and the recess means intersects with end wall 99 so as to be generally open-ended, i.e. an open-ended portion of the recess means intersects with end wall 99. Exterior free end surfaces **99*a*, 101*a* are provided on end walls 99, 101, and free end surface 99*a* extends generally circumferentially about recess means 99 so as to generally define the circumferential extent thereof. An opening or passage 105 is provided through at least one of the end or base wall 101 and sidewall 103 of casing 87 so as to intersect with recess means 89 generally adjacent the end wall 101, and a plurality of spacers, such as nipples or abutments 107, are integrally provided on the sidewall within the recess means for spacing or locating engagement with PTCR 91**.

Plate or contacting and supporting means pair 93, 95 are illustrated for purposes of disclosure as having a generally round or circular shape, but it is contemplated that plates having various other shapes or configurations may be utilized within the scope of the invention so as to meet the objects and advantageous features thereof. Plate 93 is disposed at least generally closely adjacent or in overlaying relation with casing end wall 101 within recess means 89, and means, such as an abutment or side edge portion 108, is provided on the plate for positioning or locating engagement with casing sidewall 103. Integral or male terminal 83 which extends from plate 93 is positioned or located so as to protrude through opening 105 in casing 87 exteriorly thereof when the plate is positioned or located within recess means 89. A plurality of indentations or dimples 109 may be provided in each of plates 93, 95 so as to insure good electrical contacting and mechanical supporting or positioning engagement with a pair of opposite contact sides 111, 113 of PTCR which is operable generally for controlling starting the prime mover 21 when connected in circuit relation with winding circuit 19 thereof, as discussed in detail hereinafter.

PTCR 91 is generally cylindric in shape and operable generally in response to current flow therethrough to vary or increase its resistance generally as a function of its temperature so as to generate heat when energized, and of course, opposite sides 111, 113 of PTCR 91 are coated or otherwise covered or layered with a chemical composition (not shown) so as to insure the generally even or constant flow or distribution of current through the PTCR from one of the opposite sides to the other thereof. In this manner, PTCR 91 is embraced, i.e., supported or positioned in both the electrical contacting and positioning or supporting engagement, between contact plates 93, 95 within recess means 89 of casing 87. While PTCR 91 is shown having a generally cylindric shape, it is contemplated that a PTCR having a shape other than cylindric may be employed within the scope of the invention so as to meet the objects thereof.

Plate 95 is arranged so as to overlay or otherwise be disposed on free end surface **99*a* of end wall 99 of casing 87 so as to at least in part close recess means 89 with indentations 109 of the plate engaging contact side 113 of PTCR 91 within the recess means, and, of course, integral or male terminal 85 of the plate is disposed so as to extend or be located exteriorly of casing 87. With plate 95 so associated with casing 87, as described above, the strap plurality 97 of the plate extend generally beyond the circumferential extent of free end surface 99*a* and may then be bent or otherwise deformed away from the plane of the plate generally about casing 87 and into releasable securing or gripping engagement therewith so as to prevent the displace of the plate from casing end wall 99 and to maintain PTCR 91 against displacement from recess means 89. In other words, straps 97 are initially bent away from the plane of plate 95 so as to extend generally in overlaying relation with casing sidewall 103 at least closely adjacent thereto exteriorly of casing 87, and the distal or free ends or portions 114 of the straps are thereafter bent or otherwise deformed so as to overlay casing end wall 101 in the aforementioned holding, gripping or releasably securing engagement therewith. To complete the description of solid state device 31, means, such as a wavy washer type spring 115** or the like, is associated with plate 93 and casing end wall 101 within recess means 89 for resiliently urging plate 93 toward its electrical contacting engagement with contact side 111 of PTCR 91 and contact side 113 thereof toward its electrical contacting engagement with plate 95 however, it is contemplated that suitable resilient means other than spring 115 may be provided to effect the engagement between the PTCR and the plates within the scope of the invention so as to meet the objects thereof.

With reference in general to the drawings and again recapitulating at least in part with respect to the foregoing, a method in one form of the invention is provided for assembling solid state device 31. In this method, plate 93 is positioned or otherwise located in recess means 89 so as to electrically contact and support PTCR 91 therein with terminal 83 protruding at least in part through casing opening 105 (FIGS. 5 and 6). PTCR 91 is inserted into recess means 89 so as to be located therein in the contacting and supporting engagement with plate 93. Plate 95 is then arranged on casing 87 in engagement with PTCR 91 and so as to enclose at least in part recess means 89, and the plate is thereafter secured to casing 87 with terminal 85 disposed exteriorly of the casing (FIGS. 5 and 8). Of course, upon the assembly of the component parts of solid state device 31, as discussed above, such device may then be assembled to relay means 22 with plate terminals 83, 85 mechanically and electrically mounted or connected directly with switch means terminal 57 and dummy terminal 81, as previously discussed and shown in FIG. 2.

Figure 9:
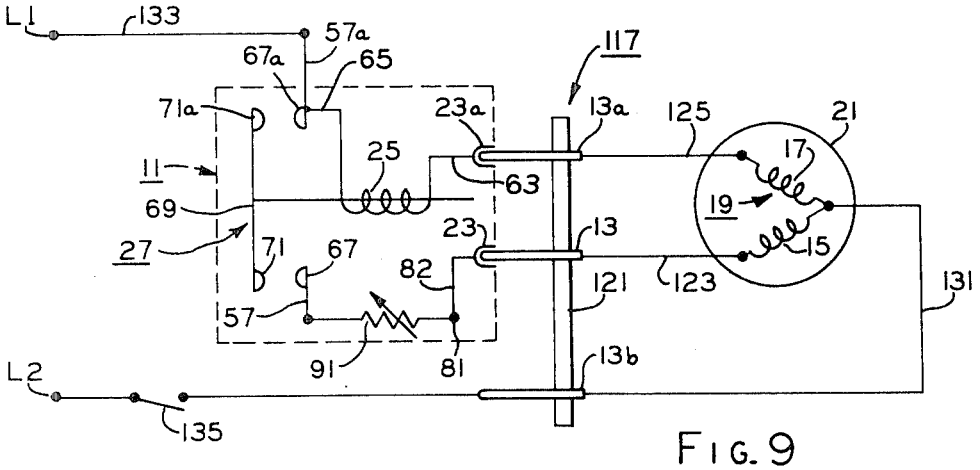
FIG. 9 is an exemplary circuit diagram showing the device of FIG. 1 schematically connected therein.

Referring to an exemplary circuit 117 shown in FIG. 9, male terminals 13, 13*a* and a third male terminal 13*b* may be mounted in a Fusite plug 121, if desired, on apparatus, such as a compressor for instance (not shown) having a hermetic environment in which prime mover 21 operates. Of course, male terminals 13, 13*a*, 13*b* may also be mounted in various other manners well-known to the art on supporting structure (not shown) of prime mover 21 within the scope of the invention so as to meet the objects and advantageous features thereof. Male terminals 13, 13*a* are connected by leads 123, 125 with auxiliary or start winding means 15 and main or run winding means 17 of prime mover 21, and a return lead 131 interconnects the auxiliary and main winding means through male terminal 13*b* to a power terminal L2 which represents one side of a power source L1, L2. To complete the exemplary circuit, another lead 133 is connected between power terminal L1 and switch means terminals 57*a* in electrical device 11, and an on-off type switch 135 may be interconnected in lead 131 (or lead 133 if desired) for controlling the energization of prime mover 21 across power source L1, L2.

In the operation of electrical device 11 in circuit 117 with the components thereof in their at-rest positions as shown in the drawings and described hereinabove, an operator may close on-off switch 135 to effect the energization of prime mover 21 across power source L1, L2. With on-off switch 135 closed, current may flow from power terminal L1 through lead 133, switch means terminal 57*a*, coil means 25, female terminal 23*a*, male terminal 13*a*, lead 125 to main winding means 17 of prime mover 21 and therefrom through return lead 131, male terminal 13*b* and closed switch 135 to power terminal L2. Of course, upon such initial energization of prime mover 21, there is a rather heavy current draw by its main winding means 17, and coil means 25 of electrical device 11 is responsive to such current draw to establish a magnetic field coupling with armature means 75 causing it to throw or rise (as best seen in FIG. 4) upwardly against the compressive force of spring 77. Of course, the force exerted by the rising movement of armature means 75 against spring 77 is transmitted therethrough to sleeve 73, and the sleeve rises on pin 51 generally conjointly with the rise of the armature means. In this manner, bridge or bridging means 69 is moved upwardly with sleeve 73 until contacts 71, 71*a* on the bridge are moved into a circuit completing position in making engagement with contacts 67, 67*a*. When contacts 71, 71*a* are made with contacts 67, 67*a*, current flows from switch means terminal 57*a* through bridge 69 to switch means terminal 57 and therefrom through plates 93, 95 and PTCR 91 of solid state device 31, dummy terminal 81, lead 82, female terminal 23, male terminal 13 and lead 123 to effect the energization or excitation of auxiliary winding means 15 generally simultaneously with the above described excitation of main winding means 17.

During the starting time period of prime mover 21, i.e. the period of time consumed in bringing it from a standstill position to its preselected speed, PTCR 91 is energized by the current draw of auxiliary winding means 15 through electrical device 11, and generally about the time the prime mover attains its preselected speed, i.e., generally at the end of the starting time period of the prime mover, the PTCR becomes heated to its anomaly or Curie point temperature with an accompanying increase in the resistance thereof so as to inhibit current flow to auxiliary winding means 15 of the prime mover. In this manner, the inhibition of current flow by PTCR 91 generally as prime mover 21 attains its preselected speed renders auxiliary winding means 15 generally ineffective in winding circuit 17 of prime mover 21. Thereafter, prime mover 21 is energized in its running mode generally at the preselected speed across line terminals L1, L2 in response to the continued excitation of main winding means 17 in circuit relation with the line terminals.

Generally as prime mover 21 attains its preselected speed so as to translate from the starting mode to the running mode operation thereof, as discussed above, an appreciable reduction of the current drawn by main winding means 15 is occasioned. Of course, the occurrence of this current draw reduction or preselected electrical condition is, in effect, sensed by coil means 25, and when the current draw is so reduced to a predetermined drop-out value for electrical device 11, the magnetic affect and excitation of the coil means is correspondingly reduced. Thus, at the predetermined drop-out value, the magnetic coupling between coil means 25 and armature means 75 is insufficient to hold the armature means against the compressive force of spring 77 acting thereon. As a result, the compressive force of spring 77 drives armature means 75 in a downward direction (as best seen in FIG. 4) so as to strike a hammer-like blow onto bridge 69 causing it to break or move its contacts 71, 71*a* away from contacts 67, 67*a* in a very positive manner, and thereafter spring 77 drives the armature means, the bridge and sleeve 71 toward their at-rest or circuit interrupting positions. Of course, upon the opening or breaking of contacts 71, 71*a* from contacts 61, 61*a*, both PTCR 91 and auxiliary winding means 15 of prime mover 21 are placed in open circuit relation with respect to power source L1, L2, i.e., current flow through switching means 27 toward the PTCR and the auxiliary winding means is interrupted. Additionally and in response to the above discussed movement of switching means 27 to its circuit interrupting position, the de-energization of PTCR 91 not only alleviates any voltage drop thereacross but also permits it to cool in anticipation of a subsequent starting mode operation of prime mover 21.

From the foregoing, it is now apparent that novel methods of assembling an electrical device have been presented meeting the objects and advantageous features set out hereinabove, as well as others, and that modifications as to the precise configurations, shapes, details and connections of such electrical devices, as well as the precise steps of the methods, may be made by those having ordinary skill in the art without departing from the spirit of the invention or the scope thereof as set out by the claims which follow.

What I claim as new and desire to secure by Letter Patent of the United States is:

1. A method of assembling an electrical device including a current relay having a housing with at least one female terminal therein and at least one switch means terminal extending exteriorly of the housing and with the electrical device also including a casing separate from the housing and having a sidewall formed between a pair of generally opposite end walls, recess means in the casing for receiving a PTCR and having a generally open-ended portion intersecting with one of the opposite end walls, and a passage in the casing extending through at least the sidewall thereof and communicating with the recess means, the method comprising the steps of:

(a) positioning in the recess means at least closely adjacent the other of the opposite end walls a contact plate with a terminal thereof extending through the passage exteriorly of the casing;

(b) inserting the PTCR into the recess means with one of a pair of opposite contact sides of the PTCR in electrical contacting engagement with the contact plate;

(c) arranging another contact plate on the one opposite end wall so as to at least in part close the open-ended portion of the recess means with the another contact plate being adapted for electrical contacting engagement with the other of the contact sides of the PTCR and with the another contact plate having another terminal exteriorly of the casing;

(d) deforming a plurality of fingers on the another contact plate generally over the sidewall of the casing exteriorly thereof and engaging a plurality of distal ends respectively on the fingers of the plurality thereof with the other opposite end wall of the casing exteriorly thereof so as to releasably secure the another contact plate to the casing;

(e) disposing the casing at least adjacent the housing of the current relay with the other opposite end wall of the casing arranged generally in facing relation with the housing; and (f) mounting one of the first named and another terminals of the first named and another contact plates in both mechanical and electrical contacting engagement directly onto the at least one switch means terminal of the current relay with the other of the first named and another terminals of the first named and another contact plates being connected in circuit relation with the at least one female terminal of the current relay.

2. A method of assembling an electrical device having a casing with recess means therein, an exterior free end surface on the casing extending generally circumferentially about the recess means, and an opening in the casing spaced from the exterior free end surface and communicating with the recess means, the method comprising the steps of:

(a) positioning in the recess means a means for electrically contacting and supporting a solid state component with a terminal means of the electrically contacting and supporting means protruding at least in part through the opening;

(b) inserting the solid state component into the recess means into engagement with the electrically contacting and supporting means;

(c) overlaying the exterior free end surface of the casing with another means for electrically contacting and supporting the solid state component within the recess means and arranging a plurality of parts of the another electrically contacting and supporting means so as to extend generally beyond the circumferential extent of the exterior free end surface; and (d) bending the parts of the another electrically contacting and supporting means exteriorly across the casing into displacement preventing engagement with another exterior free end surface of the casing oppositely spaced from the first named exterior free end surface.

3. The method as set forth in claim 2 comprising the preliminary step of disposing resilient means in the recess means for urging the first named electrically contacting and supporting means toward the solid state component and the solid state component toward the another electrically contacting and supporting means.

4. A method of assembling an electrical device having a casing with a sidewall interconnected between a pair of generally opposite end walls, a recess in the casing intersecting with one of the opposite end walls thereof, and a passage through at least the sidewall communicating with the recess, the method comprising the steps of:

(a) positioning in the recess at least adjacent the other of the opposite end walls a contact plate and extending an integral terminal of the contact plate through the passage and exteriorly of the casing;

(b) disposing a PTCR in the recess in electrical contacting engagement with the contact plate; and (c) overlaying another contact plate on a free end surface of the other of the opposite end walls so as to at least in part close the recess and engage with the PTCR and extending a plurality of fingers integral with the another contact plate generally beyond the sidewall of the casing; and (d) deforming the fingers generally over and across the sidewall exteriorly of the casing and engaging the distal ends of the fingers with the one opposite end wall exteriorly of the casing so as to releasably secure the another contact plate to the casing.

5. The method as set forth in claim 4 comprising the preliminary step of biasing a resilient means between said one opposite end wall and the first named contact plate for urging it toward the electrical contacting engagement with the PTCR and the PTCR toward the electrical contacting engagement with the another contact plate.

6. A method of assembling an electrical device having a casing with a sidewall integrally formed between a pair of generally opposite end walls, recess means in the casing for receiving a PTCR and having a generally open end portion intersecting with an exterior free end surface on one of the opposite end walls, the method comprising the steps of:

(a) overlaying the exterior free end surface of the one opposite end wall with a means for electrically contacting and supporting the PTCR so as to at least in part close the open end portion of the recess means and arranging a plurality of extensions on the electrical contacting and supporting means to extend generally beyond the sidewall of the casing; and (b) deforming the extensions on the electrically contacting and supporting means generally over the sidewall exteriorly of the casing and engaging a plurality of free ends on the deformed extensions with the other of the opposite end walls exteriorly of the casing so as to releasably secure the electrically contacting and supporting means to the casing.

7. A method of assembling an electrical device having a casing with a generally open-ended recess therein, an exterior free end surface on the casing extending generally circumferentially about the recess therein, and at least a PTCR within the recess, the method comprising the steps of:

(a) overlaying the exterior free end surface on the casing with a means for electrically contacting and supporting the PTCR and extending a plurality of extensions on the electrically contacting and supporting means generally beyond the circumferential extent of the exterior free end surface; and (b) deforming the extensions on the electrically contacting and supporting means generally about an exterior part of the casing and into gripping engagement therewith so as to releasably secure the electrically contacting and supporting means to the casing.

8. A method of assembling an electrical device having a casing with a generally annular sidewall integrally formed between a pair of generally opposite end walls, a recess in the casing intersecting with one of the end walls and with the one end wall having an exterior free end surface extending generally circumferentially about the recess, an opening in the sidewall at least adjacent the other of the end wall, a pair of generally planar contact plates having a pair of male terminals extending therefrom, respectively, one of the contact plates including a plurlaity of integrally formed generally planar fingers extending outwardly therefrom, a spring device, and a PTCR having a pair of opposite contact sides, the method comprising the steps of:

placing the spring device within the recess in engagement with the other end wall;

passing one of the male terminals on the other of the contact plates through the opening and seating the other contact plate within the recess onto the spring;

positioning the PTCR within the recess and engaging one of the contact sides of the PTCR with the other contact plate;

overlaying the exterior free end surface with the one contact plate so as to at least in part close the recess with the other opposite contact side of the PTCR engaging the one contact plate and extending the fingers and the other of the male terminals on the one contact plate generally beyond the circumferential extent of the exterior free end surface;

deforming the fingers generally away from the plane of the one contact plate and overlaying the deformed fingers in other planes generally across an exterior portion of the sidewall of the casing, respectively; and bending distal end portions from the planes thereof extending across the exterior portion of the sidewall of the casing generally into another plane in which the distal end portions of the fingers are grippingly engaged with the other end wall exteriorly of the casing.

* * * * *

UNITED STATES PATENT AND TRADEMARK OFFICE

CERTIFICATE OF CORRECTION

PATENT NO. : 4,241,494

DATED : December 30, 1980

INVENTOR(S) : Lee O. Woods

It is certified that error appears in the above—identified patent and that said Letters Patent is hereby corrected as shown below:

Col. 2, line 27, delete "has" and insert --had--.

Col. 3, line 67, delete "a current relay and a solid state device ar-" and insert --arranging a terminal means for a solid state component exteriorly of a casing therefor so as to releasably retain the terminal means against displacement from the casing--;

line 68, delete "ranged so that selected terminal means thereof are me-".

Col. 4, line 1, delete "chanically and electrically interconnected in circuit";

line 2, delete "relation";

line 9, delete "including" and insert --having a casing with a generally open-ended recess therein, an exterior free end surface on the casing extending generally about the recess therein, and at least one PTCR within the recess. In this method, the exterior free end surface on the casing is overlaid with a means for electrically contacting and supporting the PTCR, and a plurality of extensions on the electrically contacting and supporting means are extended generally beyond the circumferential extent of the exterior free end surface. The extensions on the electrically contacting and supporting means are deformed generally about an exterior part of the casing and into gripping engagement therewith so as to releasably secure the electrically contacting and supporting means to the casing.--;

UNITED STATES PATENT AND TRADEMARK OFFICE

CERTIFICATE OF CORRECTION

PATENT NO. : 4,241,494

DATED : December 30, 1980

INVENTOR(S) : Lee O. Woods

It is certified that error appears in the above—identified patent and that said Letters Patent is hereby corrected as shown below:

Col. 4, lines 10-36, delete in their entirety;
line 41, delete "in one form of";
line 42, delete "the invention";
line 53, delete "of" and insert --in--.
Col. 5, line 39, delete "therefore" and insert --therefor--.
Col. 7, line 10, delete "in one form of the invention".
Col. 8, line 56, delete "displace" and insert --displacement--.
Col. 9, line 5, after "95" insert --; however, it is contemplated that suitable resilient means other than spring 115 may be provided to effect the engagement between the PTCR and the plates within the scope of the invention so as to meet the objects thereof--.
Col. 11, lines 20-68, delete in their entirety.
Col. 14, line 9, delete "plurlaity" and insert --plurality--.

Signed and Sealed this

Seventh Day of December 1982

[SEAL]

Attest:

GERALD J. MOSSINGHOFF

Attesting Officer

Commissioner of Patents and Trademarks